United States Patent [19]

Hall

[11] Patent Number: 5,042,714

[45] Date of Patent: Aug. 27, 1991

[54] COLLAPSIBLE GROCERY CONTAINER

[76] Inventor: John B. Hall, 635 Elysian Fields Rd., Nashville, Tenn. 37211

[21] Appl. No.: 394,890

[22] Filed: Aug. 17, 1989

[51] Int. Cl.[5] ..... B65D 5/36

[52] U.S. Cl. ..... 229/117

[58] Field of Search ..... 229/117, 117.01, 117.03

[56] References Cited

U.S. PATENT DOCUMENTS

| | | | |
|---|---|---|---|
| 2,011,232 | 8/1935 | Parks et al. | 229/117 |
| 2,677,494 | 5/1954 | Buttery | 229/117 |
| 2,914,237 | 11/1959 | Malmad | 229/117 |
| 2,918,205 | 12/1959 | Zeitter | 229/117 |
| 3,722,782 | 3/1973 | Collie | 229/117 |
| 4,005,815 | 2/1977 | Nerenberg et al. | 229/117 |
| 4,095,735 | 6/1978 | Stone | 229/117 |

FOREIGN PATENT DOCUMENTS

| | | | |
|---|---|---|---|
| 233461 | 5/1964 | Austria | 229/117 |
| 487673 | 10/1952 | Canada | 229/117 |
| 2593141 | 7/1987 | France | 229/117 |

*Primary Examiner*—Gary E. Elkins

*Attorney, Agent, or Firm*—John P. Halvonik

[57] ABSTRACT

A collapsible, grocery bag container made of light-weight plastic or cardboard which can be used by consumers to store groceries in the back of the car. The container can be readily converted from its stored, space saving position to its in-use position without having to be set up or needing to be manipulated by the consumer.

2 Claims, 2 Drawing Sheets

FIG. 1.
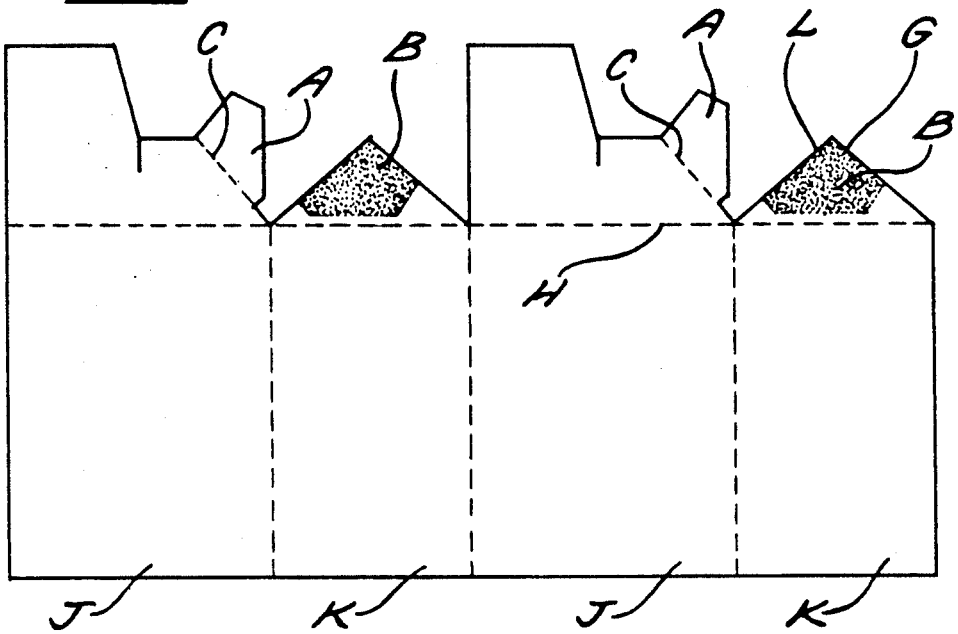
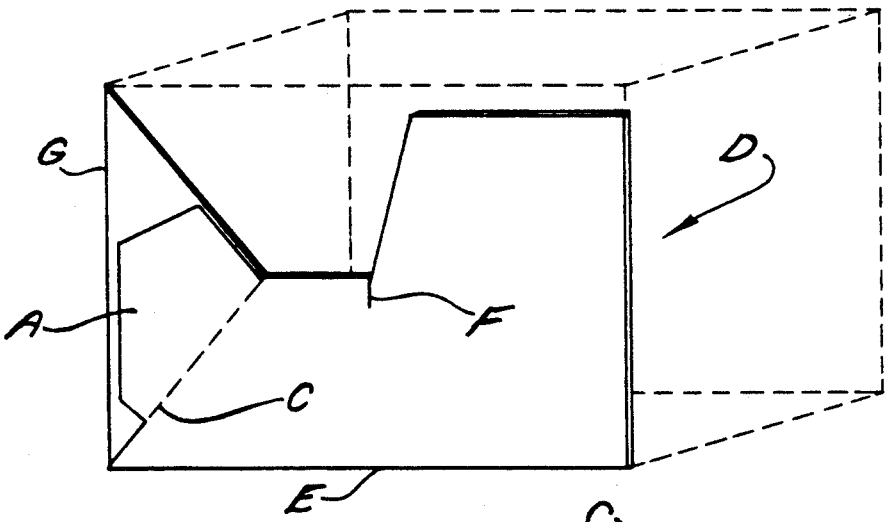
FIG. 2.
FIG. 3.
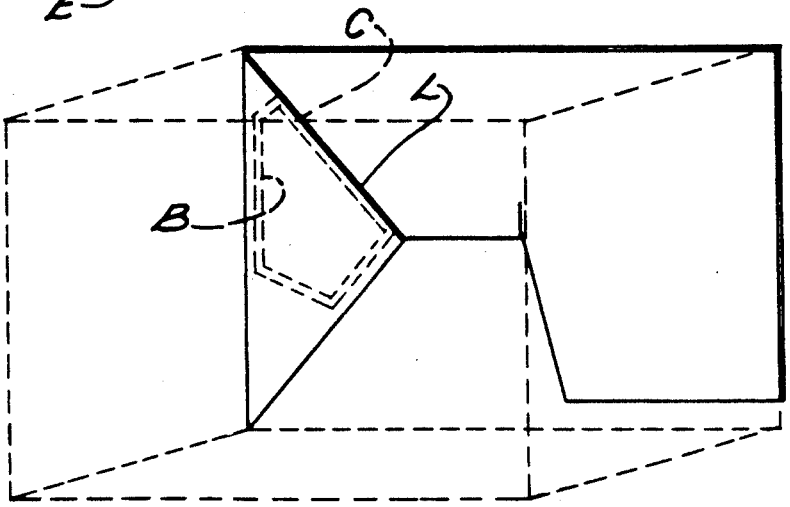

COLLAPSIBLE GROCERY CONTAINER

BACKGROUND OF THE INVENTION

1. Field of the Invention

The invention is directed toward lightweight, foldable, collapsible containers that can be used to store grocery bags in an automobile when returning from the store.

2. Description of the Prior Art

Containers have been used for storage of grocery bags in the back of cars, but none of them having all of the qualities of the present invention. Some of the foldup variety are made of metal with attendant problems in cost of manufacture because of the metal hinges and locking means. Others are made of a framework which is then covered with a fabric to serve as the support for the groceries. These devices require time to set up before their use and require time to break down or fold up when not in use.

SUMMARY OF THE INVENTION

The invention is designed for a consumer returning from the grocery store, loaded down with groceries, to place them in a storage container that can be folded up when not in use. It is desirable to have a ready to use container in the back of the vehicle that wastes no time being set-up because the busy shopper is typically loaded down with groceries and in a hurry. The container immediately converts from its stored, folded up, position to a locked position once the groceries are placed in the bag. The container achieves this because its stored, folded-position is upright with the consumer only having to place her bags in the opening between the walls and the container is opened. The container is locked into the open position by the weight of the bags.

A grocery container of this type should have the qualities of being able to be used quickly and with simple manipulations for the consumer who typically only has one hand to use. Also, it should be able to be folded up for easy storage when not in use. The invention can fold up to a thickness of 2 inches. The grocery container should also be able to be fashioned without undue labor and out of inexpensive materials, for instance, cardboard or plastic. Toward this end, most of the container is of simple design, with the folding elements being simply bendable cardboard.

It is the object of this invention to provide a low cost, easy to use, collapsible, storage container for the storage of groceries.

Another object is to provide a foldable grocery container that can be utilized by the consumer with out having to take time to set it up.

Another object is to provide a grocery storage container that can be opened with one hand while the other is holding the bags.

Another object is to provide a grocery container that requires no assembly steps to use it.

It is another object of the invention to provide a container that can be inexpensively produced without the need for complicated parts or relatively expensive materials.

It is still another object of the present invention to provide a grocery container that will lock into place when grocery bags are placed in it and can be readily folded up when not in use.

Still another object of the present invention to hold sacks and bags in an upright position in an automobile.

Still another object of the invention is to provide a grocery storage container with a low center of gravity that will not tip over when used in a car.

Another object is to provide a grocery container that can be carried by hand.

BRIEF DESCRIPTION OF THE DRAWINGS

FIG. 1 illustrates the outline of the blank that these boxes can be made of.

FIG. 2 shows the result of the gluing together of a bottom flap and a wing when viewed from beneath the box.

FIG. 3 shows the same pair as in FIG. 2 as viewed from above.

DESCRIPTION OF THE PREFERRED EMBODIMENT

Figure 4:
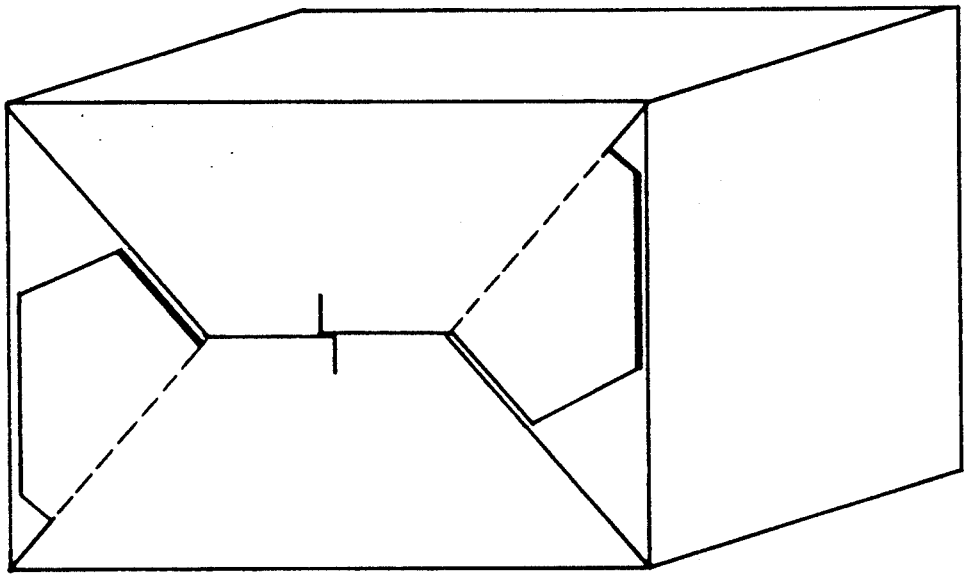
FIG. 4 shows the bottom of the completed box viewed from below.
Figure 5:
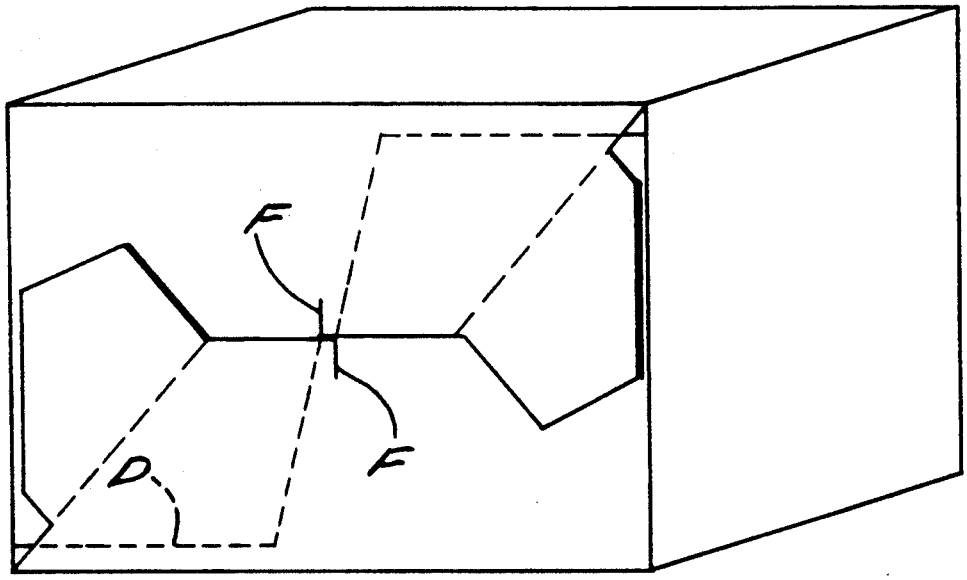
FIG. 5 shows the same view as FIG. 4 without the wing pieces and with dotted lines to illustrate the extended parts of the bottom flaps and their interlocking.

The collapsible grocery storage container is typically made of cardboard or plastic. It is generally of the shape and configuration of a cardboard box. In this invention, the box is modified to allow itself to be stored in an upright, folded up, position. By 'upright' it is meant that the sides of the box are perpendicular to the floor and the space between the folded up front and back walls, J, of the container can be accessed from above the upright container by placing grocery bags in the space and letting them come to rest in the bottom of the box. The weight of the bags themselves will keep the box in the open position.

When the container is in the folded up, closed, position the walls fold up sideways with the front, back, and side walls, J and K in a straight line that is flush against the line of the back wall and the other side wall. This is the space-saving position the container is in when not in use. The space between these walls is thus parallel to the front and side walls of the container and can be easily accessed by placing goods on top of the container. The bottom wings, G, on each side are folded flush against the side walls when in the folded up position. The two bottom flaps, H, are also folded up, flush, against the front and back walls when in this position. Portions of these bottom flaps (part A in FIG. 1) are glued or otherwise attached to the wings, G, along a triangular attaching portion, B, so that the bottom wall is actually folded along line C to facilitate the folding of the bottom walls and flaps against the front, back, and side walls when in the folded up position. The fold line C between a wing and a bottom wall can be in a variety of positions vis a vis the gluing portion B. What is shown is the preferred embodiment.

FIGS. 2 and 3 are meant to better show the configuration of the bottom flaps versus the wings. FIG. 2 shows what the underside of a joined wing and flap look like. A portion of the wing, G, only is shown as this is obscured by that portion of the bottom flap, A, that is attached to the wing. Note that fold line C does not coincide with the edge of the wing, L, but approximately parallels it. This is better shown in FIG. 3 which shows the same pair of joined wing and bottom flaps from above, with the wing now being more prominent.

Portion B in FIG. 3 is actually hidden from view when viewed form above.

The two bottom flaps are also designed so that they can be locked into place vis a vis the corresponding bottom flap when the box is in the open position. This is achieved by cutting that edge, D, (the "opposite edge") of each bottom flap that is opposite that edge E (that edge that contacts the front or back wall) on an angle. See FIG. 2. Thus, from a point near the center of the opposite edge the angle portion starts and continues on to nearly the end of the edge. Thus, a portion of the bottom flap, D, is of a larger width than the rest of the bottom flap. This portion of the bottom flap that has the larger width is that side that is away from the side that is connected to the wing at the attaching portion, E. Near the center point of each of the opposite edges is a slot that is perpendicular to the edge, F. This slot fits into the angled portion on the other bottom flap and thus these bottom flaps will lock into place with each other when a grocery bag is placed in the container.

When a package of goods is placed on the top of the container the walls are forced apart and the container assumes a "box configuration." By "box" configuration it is meant that the container takes the shape of normal cardboard box. See FIG. 4. This is the typical open position as viewed from the bottom and is the position assumed by the container when the bags of groceries are placed in the container. When this happens the bottom flaps are forced against the slot in the opposite bottom flap and the bottom flaps are thus locked into position.

When in use, the container is typically in the back of the car in its folded-up position. The consumer opens the hatch back or the car door (depending on where the container is located) and places her grocery bag on the top of the folded up container. When placed directly on the top, right where the two folded walls of the container meet, the bag will force open the two walls and they will fold out into the open configuration. The weight of the bags themselves will force the container in the locked position because the bags will force open the walls which will force the bottom portions down and they will join each other causing the locking slots to fit together.

This is one of the great advantages of this system, the container can go from its folded up position to the open, storing position with very little effort on the part of the consumer.

Optionally, handles can placed on the container or apertures cut into the container to facilitate carrying the container from the car to the house or where ever the consumer cares to take it. Thus, it is vital that the slits in the bottom portions of the container lock into place when the groceries are placed in the bag. After the bags are placed in the car, and after the trip home, the consumer merely has to lift the locked containers by their handles and carry them to the house.

Preferably, the container can be used in groups of three, with the the separate containers being joined to each other through glue or any other connecting means. Having more than one container leads to a lower center of gravity of the entire system which prevents tipping over if the car makes a sharp turn.

I claim:

1. A collapsible carton formed of an integral blank comprising:

front wall portion hingedly connected to a left side wall portion, said side wall portion hingedly connected to a back wall portion, said back wall portion hingedly connected to a right side wall portion, said front, back and side portions being of rectangular shape and connected to the side edges of each portion in turn, said front and back wall of about the same length and width, said side wall portions of about the same length as said front and back walls, said side wall portions of less width than said front and back wall portions, left and right wing flap portions having a triangular shape and hingedly connected to the top edges of said left and right side wall portions respectively, two bottom flaps each having top, bottom, left and right edges, each of said bottom edges of said bottom flap being hingedly connected to the top edges of said front and back wall portions, each of said top edges of said bottom flaps having left edge portion parallel to said bottom edge and extending to about the center of said bottom flap, said left portion connected to a first angled edge portion extending toward said bottom edge and connected to a center edge portion parallel to said bottom edge and connected to a second angled edge portion, said second angled edge extending away from said bottom edge and connected to a right edge portion, said right edge portion connected to said right edge of said bottom flap, so that said second angled portion, said right top edge portion of said bottom flap and said right edge of said bottom flap together define the boundaries of an attaching portion, said attaching portion bent away from the remainder of said bottom flap at an angle to said bottom edge of said bottom flap, the distance from said bottom edge of said bottom flap to said right edge portion is relatively large, the distance from said bottom edge of said bottom flap to said center edge portion relatively small and the distance from said bottom edge of said bottom flap to said right edge portion is relatively intermediate those distances, slit means located at that point where said first angled edge portion meets said center edge portion, said slit means extending perpendicular to said bottom edge of said bottom flap, so that said blank may be constructed by attaching said attaching portions to said wing flaps and a side edge of said front wall to a side edge of said right side wall portion so that bottom flaps are opposite one another and said first angled edges will interlock with slot means of the bottom flap opposite said first angled edge so as to form a carton of box shape that will fold flat when not in use and extend into a box shaped conformation when goods are placed within said front, back and side walls.

2. The blank of claim 1 having removed portion at that point where said right edges of said bottom flaps meet the top edges of said front and back portions so as to facilitate the bending of said attaching portion.

* * * * *